US005745936A

United States Patent [19]

Van McCutchen et al.

[11] Patent Number: 5,745,936

[45] Date of Patent: May 5, 1998

[54] SAFETY BED WITH DUAL PURPOSE SIDE PANELS

[75] Inventors: James Van McCutchen, Lafayette; Kurt Lee Shaw, Broomfield, both of Colo.

[73] Assignee: Windryder Engineering, Inc., Broomfield, Colo.

[21] Appl. No.: 374,420

[22] Filed: Jan. 19, 1995

[51] Int. Cl.[6] ..... A47C 21/08

[52] U.S. Cl. ..... 5/600; 5/611; 5/425; 5/428; 5/430

[58] Field of Search ..... 5/425, 428, 430, 5/611, 600, 427, 81.1

[56] References Cited

U.S. PATENT DOCUMENTS

| | | | |
|---|---|---|---|
| 677,671 | 7/1901 | Lausen | 5/430 |
| 2,326,379 | 10/1943 | McNuabb et al. | 5/11 |
| 3,344,445 | 10/1967 | Crawford | 5/81.1 |
| 3,465,373 | 9/1969 | Wilson | 5/53.1 |
| 4,509,217 | 4/1985 | Therrien | 5/430 |
| 5,083,334 | 1/1992 | Huck et al. | 5/430 |
| 5,090,070 | 2/1992 | Heinz | 5/430 |
| 5,179,744 | 1/1993 | Foster et al. | 5/425 |

*Primary Examiner*—Rodney M. Lindsey
*Assistant Examiner*—Fredrick Couleg
*Attorney, Agent, or Firm*—Douglass F. Vincent

[57] ABSTRACT

This invention relates to a bed for persons at risk of falling out of bed, and more particularly to a safety bed with dual purpose side panels which can be used as barriers for physical restraint, or which can alternatively allow the user to roll safely from the bed to the floor.

9 Claims, 5 Drawing Sheets

SAFETY BED WITH DUAL PURPOSE SIDE PANELS

BACKGROUND ART

Many persons are at risk of falling out of bed during sleep, and it is desirable to protect them from injury resulting from such falls. In the past, this protection has been accomplished by use of some type of physical restraint, usually safety railings or straps for holding the person in place. Those at risk of such problems may include old persons, persons with mental problems, the physically disabled, or the sick. Typically, persons in this at-risk group are using a hospital-type bed, in which the maximum height of the mattress is significantly greater than in a conventional bed. Also, in order to facilitate movement of beds and other equipment as well as cleaning, the floors of most health care and similar facilities are only thinly carpeted, if at all. Thus, a fall from such a bed, particularly by an older or more frail person, poses a serious risk and requires even greater consideration of restraint against such accidents. Most commonly, straps or safety guard rails are used for this purpose. While these restraints partially solve the problem of the person accidentally rolling out of bed, the person's freedom of conscious movement is often restrained in the process. Additionally, some persons may suffer from mental problems or disorientation which will cause them to attempt to overcome physical restraints and leave the bed, even while fully awake, with the physical restraints often being a contributing factor in possible subsequent injuries. Further, the legal and social environment is clearly moving away from restraining persons, and toward allowing them the maximum freedom consistent with their circumstances. For example, the Omnibus Reconciliation Act of 1987, which applies to long-term care facilities, mandates empowering residents and giving them the maximum freedom of choice possible. A related problem is that many of the same persons who are at risk of falling out of bed also have trouble getting into and out of bed. Beds, and particularly hospital-type beds, often have mattresses which are too high to allow such persons to comfortably enter or exit the beds. Also, the very safety railings used to restrain these persons from falling out of bed may pose obstacles to their successful ingress and egress of the same bed. In particular, many beds with safety railings require an attendant to operate the railings, which cannot be raised or lowered by the person occupying the bed. This is unfortunate, since many persons who require protective restraints during sleep do not require such restraint when awake, and their freedom is therefore unnecessarily curtailed.

Various attempts have been made to solve the above-described problems. A partial solution to the problems has been to place a mattress directly on the floor, thereby protecting the user from the hazards of falling out of bed, while simultaneously providing him with the freedom to roll out of bed. However, this solution makes it more difficult for the user to get in and out of bed, regardless of whether they are ambulatory or wheelchair bound. In addition, it is generally more awkward to provide care for a person at floor level, and friends and relatives usually do not like to see the person sleeping on a mattress on the floor.

U.S. Pat. No. 3,585,660 to Gottfried, et al, discloses rotatable safety restraint sideboards for the sides of a bed. The sideboards of Gottfried could possibly be operated by the person in the bed, without the need for an attendant. However, the sliding bolt mechanism for holding the rails in place is on the outside of the sideboards away from the user, making it more awkward for operation without an attendant. Further, the problems of ingress and egress related to the awkward height of the bed still remain with the Gottfried device. U.S. Pat. No. 3,800,342 to Tenteris, et al. The Tenteris device shows crank-operated safety sideboards offering a range of positions. However, the sideboards are clearly designed to be operated by an attendant, thus limiting the bed-user's freedom of choice and movement.

U.S. Pat. No. 5,293,655 to Van Winkle, et al, discloses a soft wall and cradle sheet combination useful for protecting an infant against hazards associated with rolling out of its crib and into the space between the crib and its parents' bed. U.S. Pat. No. 4,998,939 to Potthast, et al, discloses a guard rail safety apparatus to prevent simultaneous lowering of both a pair of guard rails to a position in which the patient might be at risk of falling out of bed. Thus, neither the Van Winkle device nor the Potthast device offer solutions to the countervailing problems of restraint and ease of access. Finally, U.S. Pat. No. 3,281,872 to Dewey shows a vertically adjustable bed. However, the Dewey bed is raised and lowered with a hand crank located at one end of the bed, thereby necessitating an attendant to raise and lower the bed. Further, the Dewey bed is limited in how low it may go because of the need for space to operate the crank. Additionally, Dewey's bed provides no help to the patient in successfully entering or leaving the bed. None of the above patents address the need to provide the user the freedom to roll out of bed with relative safety without the use of physical restraints.

There is thus a need for a safety bed which will provide the protection required by a user who is prone to falling out of bed, yet which is capable of allowing the user the maximum freedom of movement without the use of physical restraint, when conditions warrant. The bed should be capable of protecting not only against a person accidentally falling out of bed during sleep, but also against a person taking an accidental fall after consciously climbing over or removing physical restraints. Further, such a bed should facilitate care-giving by attendants of the person, by being adjustable to a convenient height and having no barriers preventing or inhibiting the attendants from having access to the person in the bed. Still further, it should be possible for the safety functions of the bed to be operated by the user of the bed when conditions allow, as well as for the user of the bed to be prevented from controlling the safety function when necessary.

DISCLOSURE OF THE INVENTION

In accordance with the present invention, a safety bed with a frame having a head end, a foot end, and two sides is provided. A mattress rests on a mattress support structure supported by the frame and has a top surface upon which a person using the bed rests. Means are provided for raising and lowering the support structure and mattress between a maximum mattress height and a minimum mattress height, the height being measured from the floor to the top surface of the mattress.

A pair of dual purpose side panels are mounted to the mattress support structure and move with the support structure as it is moved vertically. Means are provided for moving each of the panels into a substantially horizontal position in which a ramp is formed by the side panels from the top mattress surface to the floor to allow the person to move between the bed and the floor via the ramp when the support structure and mattress are lowered to their minimum height.

Preferably, the minimum mattress height obtainable will be less than twelve inches, as measured from the floor to the top of the mattress. For best results, means for automatically moving the side panels into the horizontal position will be utilized. One effective way of providing such automatic positioning of the side panels is by a cam attached to each side of the frame at floor level, with a cam follower on each of the side panels, with the cam follower following the cam as the support structure is lowered.

Based on the foregoing, a number of advantages of the present invention are readily apparent. A safety bed is provided which will protect against a user of the bed accidentally falling from the bed in the usual dangerous sense, and injuring himself. Typically, such a fall would occur when the user rolls over, either during sleep or in a conscious state, or when the user experienced a loss of muscle control such as in spasms or seizures. The side panels of the bed are dual purpose: they may be used in an upright position to provide a barrier which restrains the user against falling; or the panels may be moved to a horizontal position to form a ramp between the mattress and the floor when the bed is in its lowest position, thereby eliminating entirely the possibility of "falling out of bed," in the usual dangerous sense. In a similar fashion, the bed may also be useful for protecting users who are likely to consciously remove or climb over restraints. In such a case, the side panels may also optimally be left in their upright position with the bed lowered to its lowest height. In that configuration, the user will be protected against a serious fall even if he should climb over the upright panels, since the distance he might fall would be minimized.

Further, the panels may be lowered with the bed at or near its maximum height, in order to allow attendants or others to have ease of access to the user of the bed. This capability also allows the user himself to enter and exit the bed more easily. Still further, the bed may be lowered to its lowest height and the panels moved to their "ramp" positions to allow a partially disabled person to easily and safely enter and exit the bed, either with or without assistance. Since the bed height and the panels are easily adjusted to many different heights and positions, the particular configuration most suitable for any particular situation may be selected.

Additional advantages of this invention will become apparent from the description which follows, taken in conjunction with the accompanying drawings.

BEST MODE FOR CARRYING OUT THE INVENTION

Figure 1:
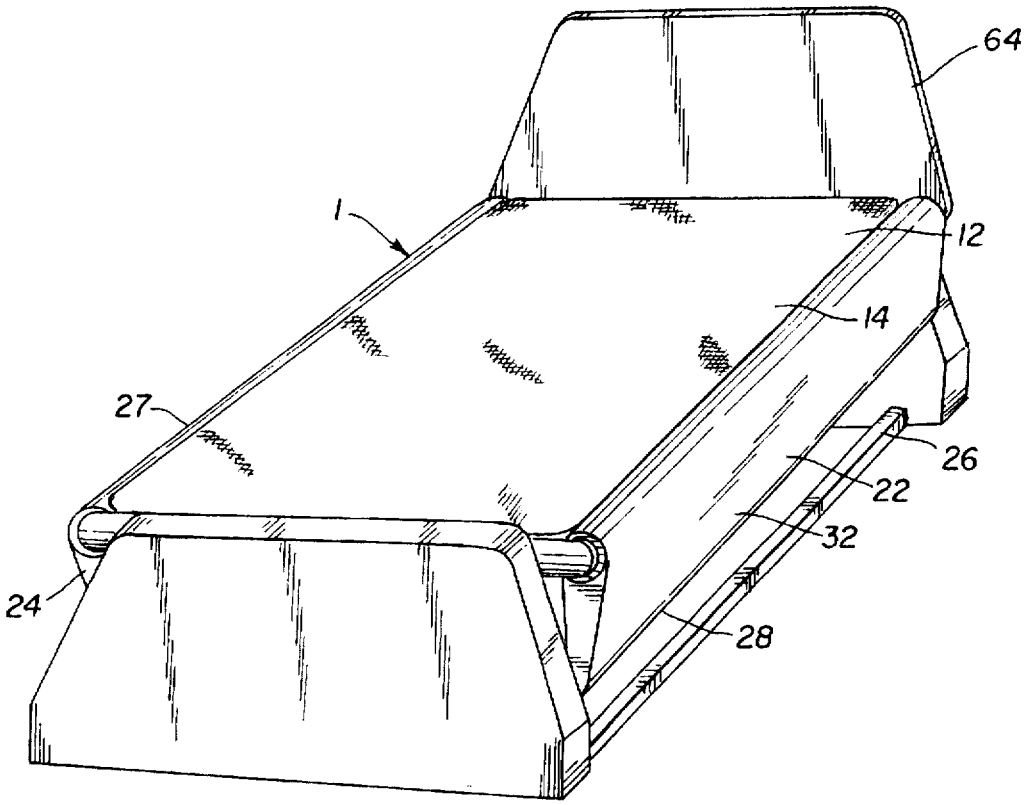
FIG. 1 is a perspective view of the bed of the present invention, showing the mattress at its maximum height with the side panels down for access to the bed.

Referring now to the drawings, as shown in FIGS. 1 through 5, a safety bed 1 according to the present invention is disclosed. The bed 1 includes a frame 2 which has a head end 4, a foot end 6, and two opposite sides 8,10. A mattress 12 is positioned on the bed so that a person may sleep on the upper surface 14 of the mattress 12. The mattress 12 rests on a mattress support structure 16, which is capable of moving upward and downward relative to the floor.

Preferably, an electric motor 18 and tension straps 20 with pulleys 21 may be used to move the mattress support structure 16 up and down. Other ways of moving the support structure 16 up and down could be employed, such as a hand-crank, but none are as suitable for the intended purpose of the bed. Optimally, the support structure 16 will be lowerable so that the bottom of the mattress 12 is within about three inches or less of the floor. The mattress support 16 should also be capable of being raised to a maximum height relative to the floor which will place the upper surface of the mattress 12 at a convenient height for the purposes of both the user of the bed, as well as any attendants of such person. Typically, this maximum height would be at least thirty to thirty-six inches above the floor.

Figure 2:
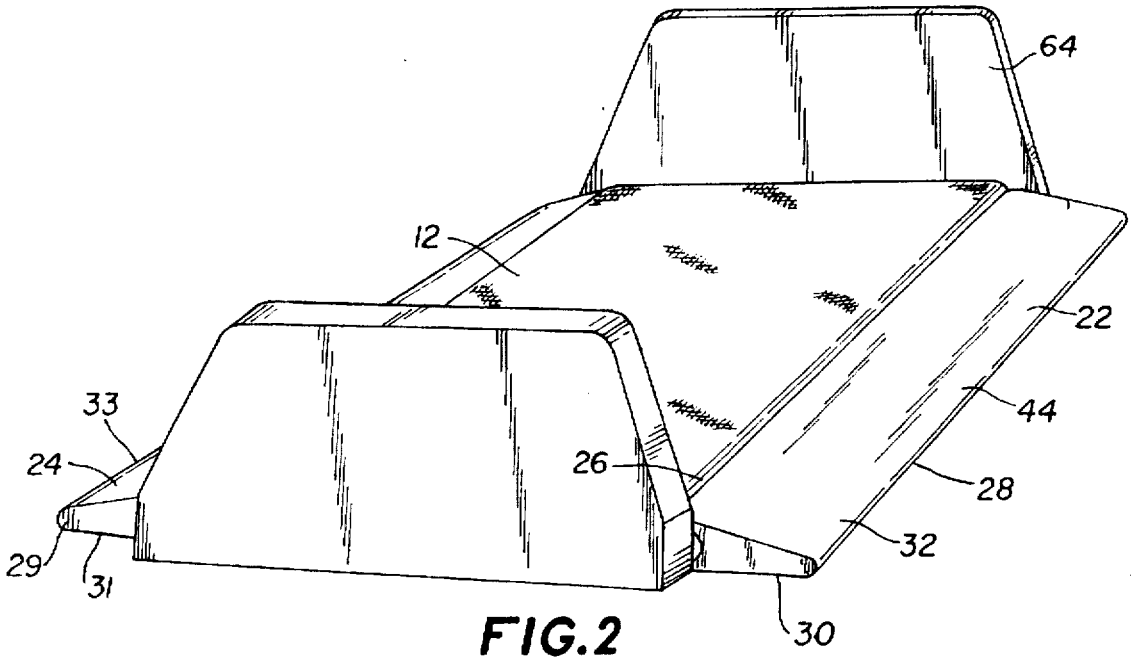
FIG. 2 is a perspective view of the bed showing the mattress at minimum height with the side panels approximately horizontal, forming a ramp between the mattress and the floor.

On either side 8,10 of the bed 1 are a pair of dual purpose side panels 22,24. The panels 22,24 are both mounted on the mattress support structure 16 so that as the support structure 16 is moved up and down, the panels 22,24 also travel up and down. Each of the side panels 22,24 has a base 26,27 and a narrow top 28,29. For best results the side panels are tapered into a wedge-shape as seen in FIGS. 1 and 2, with the base having a thickness approximately equal to the thickness of the mattress 12, and the narrow top having a thickness of approximately one to two inches. Each panel 22,24 has a first surface 30,31 and an opposing second surface 32,33.

Figure 3:
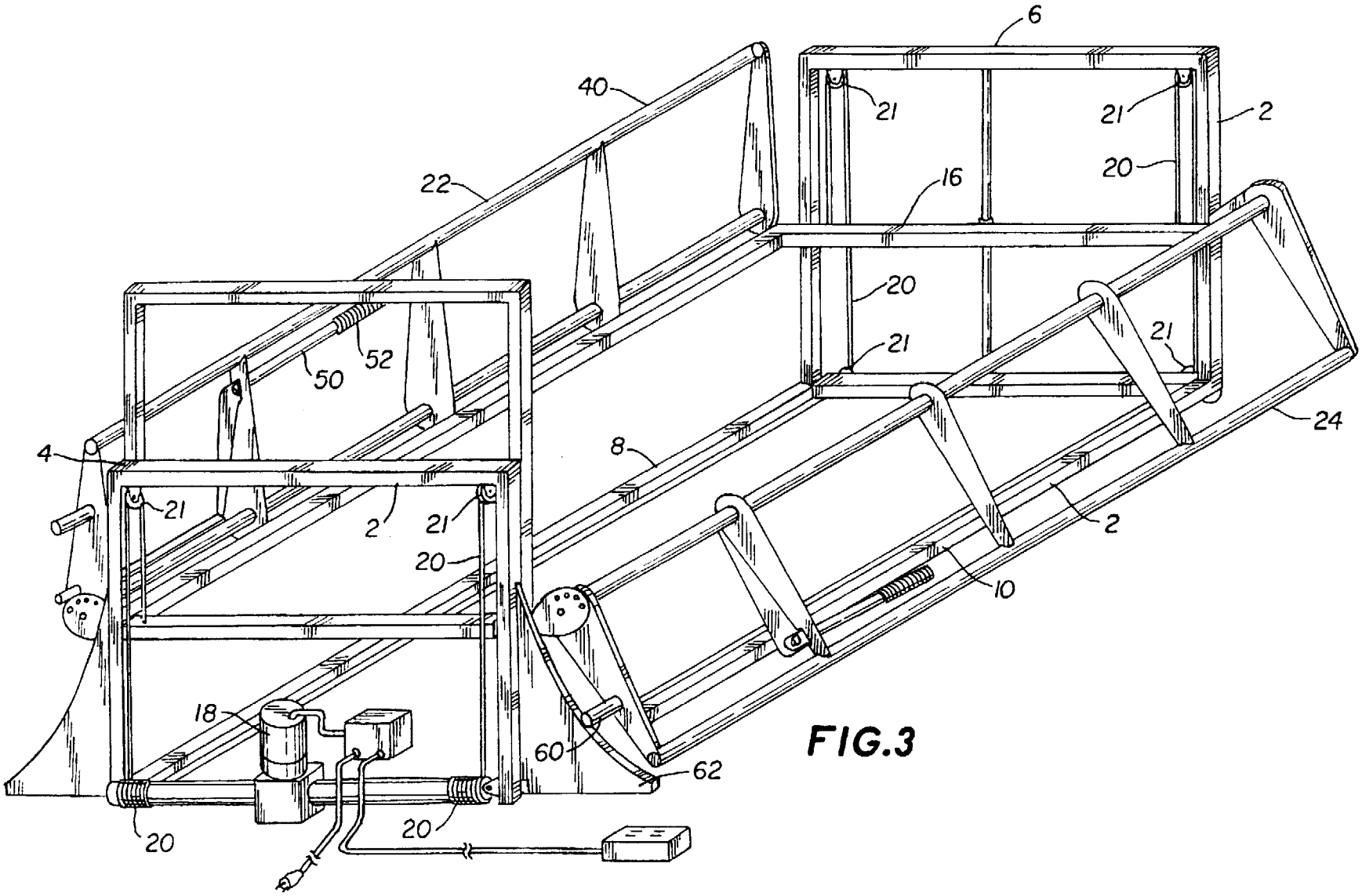
FIG. 3 is a perspective view of the skeleton of the bed, including the frame, the mattress support structure, and the side panels.

As best seen in FIG. 3, the panels 22,24 are rotatably mounted to the mattress support structure 16, so as to be able to assume at least three positions. A first panel position 40 is approximately an upright orientation of the panels 22,24, to provide protection against the user of the bed rolling out of bed from a physically dangerous height. A second panel position 42 is approximately a downward orientation, which is useful to allow ease of access to the bed by the user, as well as to allow an attendant ease of access to the user of the bed. The first and second panel positions 40,42 are well known and are used in many hospital beds, which commonly use guard rails in an up position to protect against falls from the bed, yet allow access to the bed when the guard rails are lowered into a downward orientation.

However, the safety bed 1 of the present invention also includes a third position which has not heretofore been used in hospital-type beds. Referring now to FIG. 2, a third panel position 44 occurs when the panels 22,24 are approximately horizontal. Referring now to panel 24 as shown in FIG. 2, this horizontal panel position 44 would normally be desired only when the mattress 12 is at its lowest height, so that the first panel surface 31 would rest on the floor. In this position 44, the base 27 of the panel 24 is flush with the mattress 12 since the base 27 is preferably approximately the same thickness as the mattress 12, while the narrow top 29 of the panel 24 is approximately one to two inches thick, the second panel surface 33 will act as a gently sloping ramp between the mattress 12 and the floor. When the bed 1 is arranged in this fashion, a person using the bed may not "fall out of bed" in the usual sense, because there is no place to which to fall. If the person rolls off of the mattress 12, an action which would normally result in a fall from the bed, the person instead will simply roll down the ramp formed between the mattress 12 and the floor by the side panel 24. This serves to protect users of the bed against unwanted falls from the bed. In addition, this capability of the bed allows the user to consciously enter and exit the bed 1 by using the side panel 24 as a ramp, thus providing greater freedom of choice to persons who would normally not have such choices.

An alternative to the 3-position safety panels just described would be to provide panels having only the capability of the horizontal position 44, with the panels being retracted under the bed when not in use. While this embodiment would provide many of the advantages of the 3-position safety panels, it would lack the capability of the panels being used as restraints.

Figure 4:
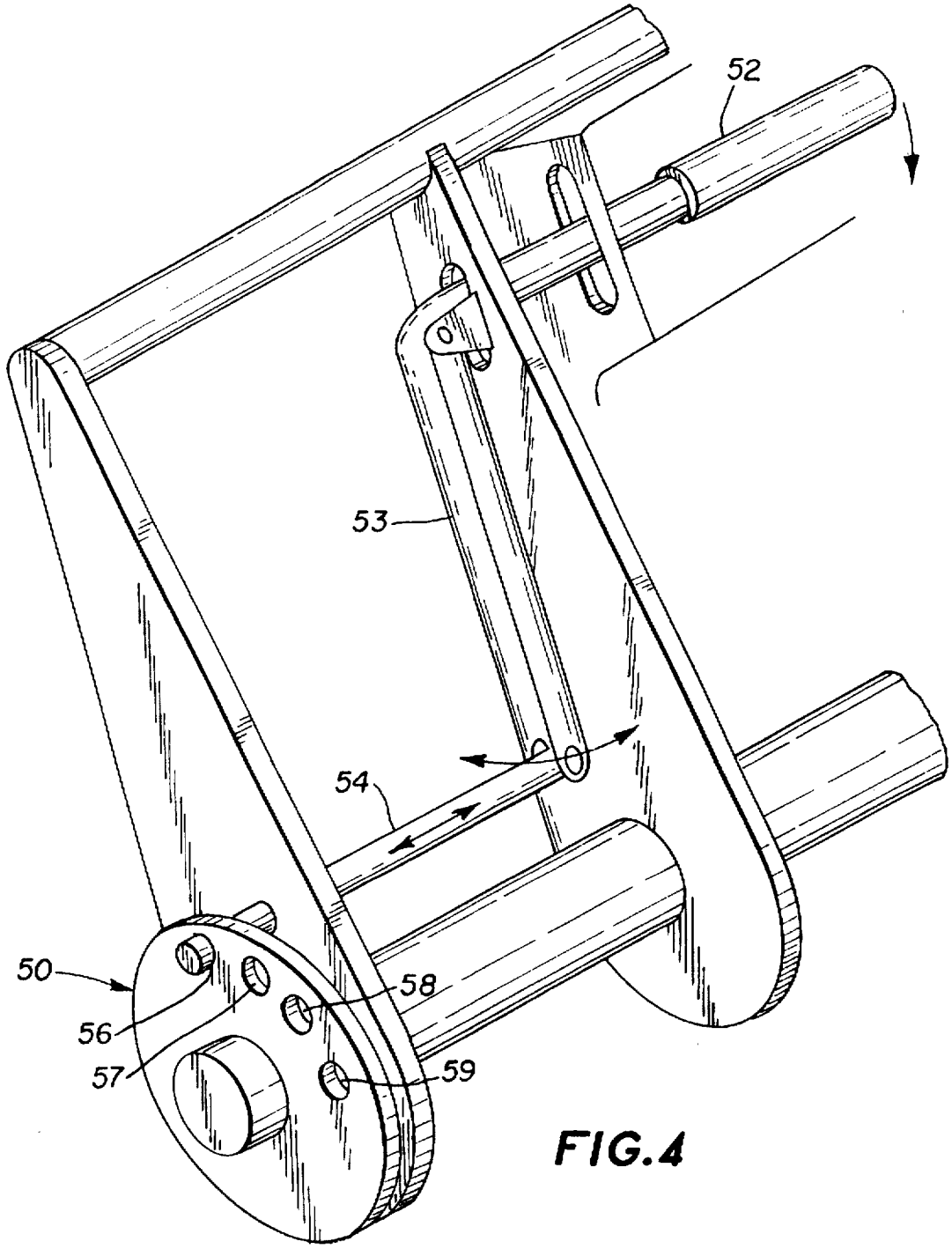
FIG. 4 is an enlarged view of the side panel lock actuating handle, showing the locking and releasing actions thereof.

Position-locking of the side panels may be provided in a variety of ways. One effective position-locking mechanism 50 is depicted in FIGS. 3 and 4. The mechanism 50 includes a handle 52 connected by a lever arm 53 to a locking pin 54. The locking pin 54 may be manipulated into any one of several locking pin slots 56,57,58,59, each of which would correspond to a selected position of the respective side panel by moving the handle 52.

If desired for safety purposes, the handle 52 may be covered so that it cannot be reached from the bed. Alternatively, a locking mechanism could be provided to prevent the user of the bed from changing the position of the side panels 22,24.

Figure 5:
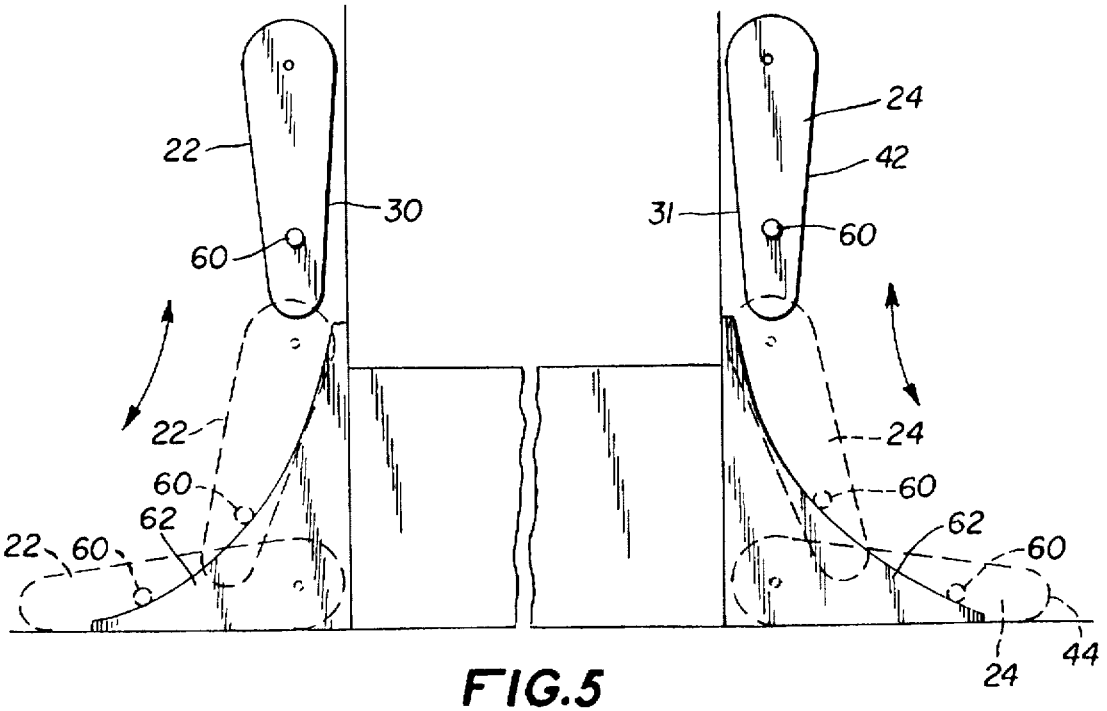
FIG. 5 is an end view of the side panels showing the interaction of the cams and cam follower interaction through various positions in the automatic extension of the side panels.

Preferably, the side panels 22,24 will automatically assume the third position 44 when starting from its downward position 42 when the mattress support structure 16 is lowered to its minimum height. One effective way to accomplish such automatic positioning is depicted in FIGS. 3 and 5. Referring now to the first side panel 22, a cam follower 60 is provided near the narrow top 28 of the panel 22. In operation, the panel 22 is first lowered into the downward position 42 and the mattress support structure 16 along with the panel 22 are then lowered. As the panel 22 proceeds downward, the cam follower 60 contacts the cam 62, and then follows the cam outward away from the bed 1, leading the panel 22 into its horizontal position 44. Alternatively, the panel 22 may be left in the upright position 40, or a position other than the downward position 42, during lowering if the automatic positioning of the panel 22 into the horizontal position 44 is not described. Optionally, a headboard 64 at one end of the mattress support structure moves in fixed relation with the support structure 16 as the structure is raised and lowered between its maximum height and minimum height.

Figure 6:
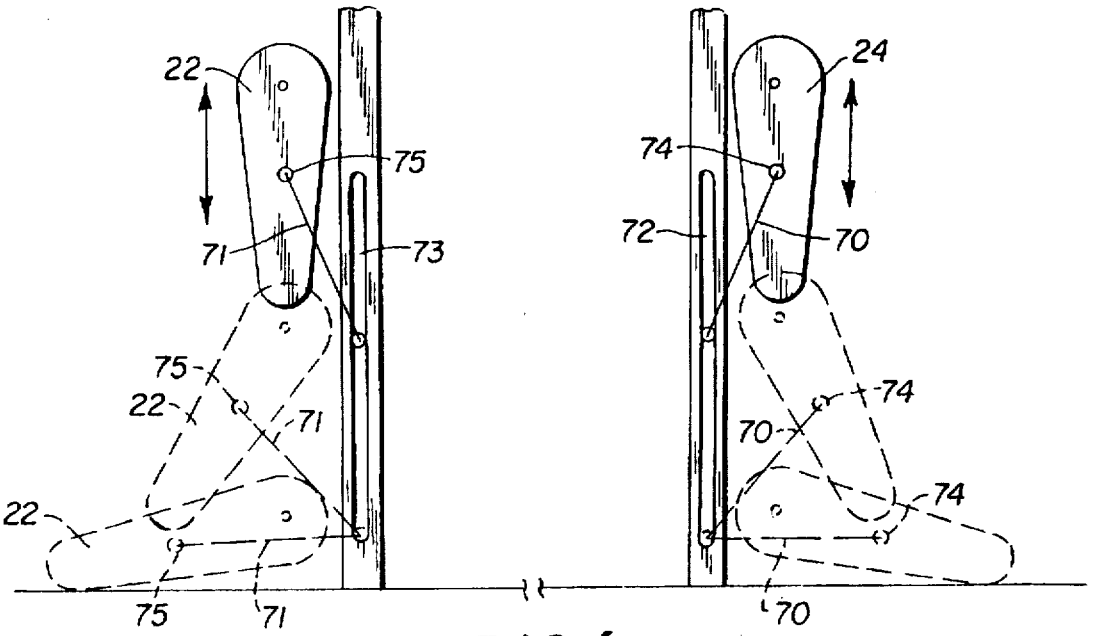
FIG. 6 is an end view of an alternative apparatus for automatically extending the side panels, including a push rod moving in a track.

Of course, various other approaches are also possible to achieve automatic positioning of the side panels 22,24 as the mattress 12 is lowered. One such alternative approach is depicted in FIG. 6. In this embodiment, a pair of push rods 70,71 are provided, which ride in slots 72,73 as the mattress is raised and lowered. Each push rod 70,71 is attached to its respective panel 22,24 at a pivot point 74,75. Referring now to panel 24, as the panel is lowered the push rod 70 slides downward in its slot 72 until it reaches the floor. The push rod 70 thereafter exerts a force from the floor through the pivot point 74, causing the panel 24 to rotate outward into its horizontal ramp position 44 as the mattress 12 is lowered to its lowest height.

Figure 7:
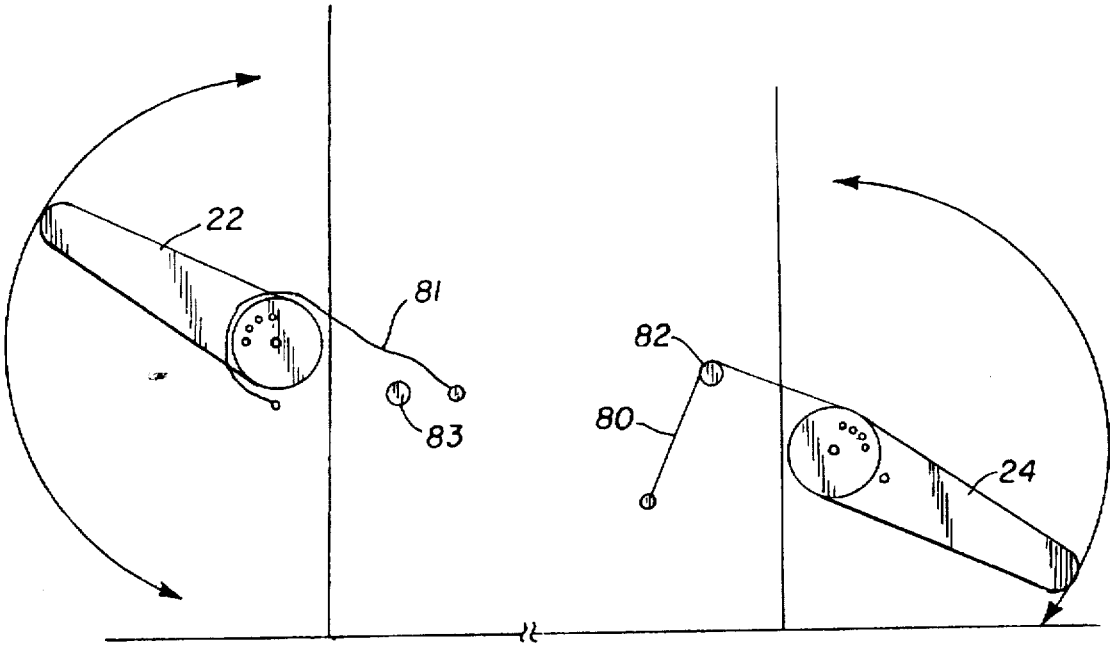
FIG. 7 is an end view of another alternative apparatus for automatically extending the side panels, including a cable which is pulled tight as it passes over a cable catch.

A similar arrangement is depicted in FIG. 7. This alternative operates in analogous fashion to the push rod alternative, but instead utilizes a pair of cables 80,81 which engage cable catches 82,83 as the panels 22,24 are lowered, again resulting in the panels 22,24 assuming the horizontal position 44 when the mattress 12 is fully lowered.

A variety of other arrangements are possible to position the panels 22,24 in the horizontal position 44 as desired. Electronic sensors could be employed to give feedback to a computer chip or other smart device, in order to operate a motor which would move the panels 22,24 into the desired position. This approach would be quite accurate and effective, but would probably be needlessly complex and expensive for most purposes. Of course, the panels could be moved manually, either by directly positioning the panels with the hands, or by use of a hand crank or the like.

This invention has been described in detail with reference to a particular embodiment thereof, but it will be understood that various other modifications can be effected within the spirit and scope of this invention.

We claim:

1. A safety bed, comprising:

a frame having a head end, a foot end, and two sides;

a mattress having a top surface upon which a person using the bed rests;

a mattress support structure supported by said frame and having the mattress mounted thereon;

means for raising and lowering said support structure and mattress between a maximum mattress height and a minimum mattress height, said height being measured from the floor to the top surface of the mattress; and a pair of side panels mounted to said mattress support structure;

means for moving each of said panels into a substantially horizontal position in which a ramp is formed by said side panels from said top mattress surface to the floor to allow the person to move between the bed and the floor via said ramp when said support structure and mattress are lowered to their minimum height; and wherein said means for moving said side panels automatically moves said side panels from a substantially downward position into said horizontal position when the bed is lowered to said minimum height.

2. A safety bed as claimed in claim 1, wherein:

said side panels are wedge-shaped, having a broad base with a width approximately equal to the minimum mattress height and a narrow top less than six inches wide.

3. A safety bed as claimed in claim 1 or 2, wherein said means for automatically positioning said side panels into said horizontal position includes:

at least one cam attached to each side of said frame at floor level; and a cam follower on each of said side panels which comes in contact with said respective cam as said side panel is lowered, said cam and said cam follower being configured to position said side panel to form a ramp between said mattress and the floor when the mattress is lowered to said minimum height.

4. A safety bed as claimed in claim 3, wherein:

said minimum mattress height is less than twelve inches.

5. A safety bed as claimed in claim 3, wherein:

said means for selectively moving said side panels automatically moves said side panels into said third position when the bed is lowered to said minimum height.

6. A safety bed as claimed in claim 5, wherein said means for automatically positioning said side panels into said third position includes:

at least one cam attached to each side of said frame at floor level; and a cam follower on each of said side panels which comes in contact with said respective cam as said side panel is lowered, said cam and said cam follower being configured to position said side panel to form a ramp between said mattress and the floor when the mattress is lowered to said minimum height.

7. A safety bed as claimed in claim 3, further including:

a headboard at one end of said mattress support structure, said headboard moving in fixed relation with said support structure as said structure is raised and lowered between said maximum height and said minimum height.

8. A safety bed as claimed in claim 7, wherein:

said side panels are wedge-shaped, having a broad base with a width approximately equal to the minimum mattress height and a narrow top less than six inches wide.

9. A safety bed as claimed in claim 7, wherein said means for automatically positioning said side panels into said third position includes:

at least one cam attached to each side of said frame at floor level; and a cam follower on each of said side panels which comes in contact with said respective cam as said side panel is lowered, said cam and said cam follower being configured to position said side panel to form a ramp between said mattress and the floor when the mattress is lowered to said minimum height.

* * * * *